US008292098B2

(12) United States Patent
Szegfi

(10) Patent No.: US 8,292,098 B2
(45) Date of Patent: Oct. 23, 2012

(54) TOILET PAPER ROLL HOLDER

(76) Inventor: Yuval Szegfi, Petach-Tiqwa (IL)

( * ) Notice: Subject to any disclaimer, the term of this patent is extended or adjusted under 35 U.S.C. 154(b) by 468 days.

(21) Appl. No.: 12/455,852

(22) Filed: Jun. 9, 2009

(65) Prior Publication Data

US 2009/0250419 A1 Oct. 8, 2009

(51) Int. Cl.
*A47F 5/08* (2006.01)

(52) U.S. Cl. ..... 211/113

(58) Field of Classification Search ..... 211/113, 211/118, 16, 119.009; D6/524, 523, 520
See application file for complete search history.

(56) References Cited

U.S. PATENT DOCUMENTS

| | | | | | |
|---|---|---|---|---|---|
| 1,700,265 | A | * | 1/1929 | Kissam | 206/394 |
| 3,063,570 | A | * | 11/1962 | Kroner | 211/113 |
| 3,688,348 | A | * | 9/1972 | Klotz et al. | 24/16 R |
| 4,195,739 | A | * | 4/1980 | Sweet, III | 211/113 |
| 4,387,873 | A | * | 6/1983 | Pavlo et al. | 248/227.1 |
| 5,117,988 | A | * | 6/1992 | Daniels | 211/113 |
| 5,137,149 | A | * | 8/1992 | Polacek | 206/278 |
| D361,234 | S | * | 8/1995 | Ball | D6/520 |
| D372,823 | S | * | 8/1996 | Kerschreiter | D6/520 |
| 5,687,854 | A | * | 11/1997 | Anderson | 211/59.2 |
| D388,989 | S | * | 1/1998 | Puckerin | D6/520 |
| 5,762,212 | A | * | 6/1998 | Pomerantz | 211/113 |
| 5,794,800 | A | * | 8/1998 | Carmo et al. | 211/113 |
| 6,010,105 | A | * | 1/2000 | Davis | 248/317 |
| 6,158,593 | A | * | 12/2000 | Olsen | 211/14 |
| D452,094 | S | * | 12/2001 | Akin | D6/515 |
| 6,929,132 | B2 | * | 8/2005 | Belt | 211/113 |
| D599,147 | S | * | 9/2009 | Antoine | D6/523 |
| 7,918,351 | B2 | * | 4/2011 | Zimmer | 211/40 |
| 2002/0109361 | A1 | | 8/2002 | Parthenis | |
| 2006/0207956 | A1 | * | 9/2006 | Sivers | 211/113 |
| 2007/0272636 | A1 | * | 11/2007 | Hale | 211/113 |
| 2009/0250419 | A1 | * | 10/2009 | Szegfi | 211/85.5 |

FOREIGN PATENT DOCUMENTS

| | | |
|---|---|---|
| DE | 88 00 861 | 7/1988 |
| DE | 298 01 070 | 5/1998 |
| EP | 0 300 357 | 1/1989 |

* cited by examiner

*Primary Examiner* — Sarah Purol

(57) ABSTRACT

A toilet paper roll holder assembly comprising: (a) at least one foldable sheet folded around itself; (b) first engagement means for engaging the foldable sheet to itself; (c) second engagement means for engaging the foldable sheet to another foldable sheet, or third engagement means for engaging the foldable sheet to supporting sheet, where the supporting sheet is not in folded form. The foldable sheets in their folded form provide closed space for holding toilet paper roll. The engagement means enables reversible assembling and disassembling of the toilet paper roll holder, and the foldable sheets and the supporting sheet are made of synthetic material.

28 Claims, 7 Drawing Sheets

TOILET PAPER ROLL HOLDER

FIELD OF THE INVENTION

The present invention relates to toilet paper roll holders, and more particularly to modular toilet paper roll holders that can be reversibly assembled and disassembled.

BACKGROUND

A variety of toilet accessories are used practically in every household and public rest rooms worldwide, and include, inter alia, paper rolls for constant necessary and daily use. Accordingly, many paper roll storing and holding devices and apparatuses have so far been developed, most of them provided already in their complete piece and final shapes, and are mostly made either of rigid metallic materials, a cloth with limited flexibility or a combination of the two.

The present invention, however, utilizes the advantages of synthetic materials in both ease of production and molding and inherent flexibility in order to provide paper roll holding and storing apparatus. Such apparatus is easily assembled from its components and also easily disassembled, thereby providing a storing and holding device that may be customized according to the particular needs and taste of the end-user.

It is, therefore, an object of the present invention to provide toilet paper roll holder assembly that is reversibly assembled and disassembled.

Still another object of the present invention is to provide toilet paper roll holder assembly that is made of flexible synthetic material.

Still another object of the present invention is to provide toilet paper roll holder assembly that is made of a printable synthetic material.

Still another object of the present invention is to provide toilet paper roll holder assembly that is made of water washable and detergent resistant synthetic material.

Still another object of the present invention is to provide toilet paper roll holder that allows adding as many rolls as needed.

Still another object of the present invention is to provide toilet paper roll holder that allows making different combinations as it is possible to crate different graphics and put them in what order that one likes.

Still another object of the present invention is to provide a method of assembling toilet paper roll holder assembly.

Still another object of the present invention is to provide a kit that comprises the components of a toilet paper roll holder assembly.

This and other objects of the invention will become apparent as the description proceeds.

SUMMARY OF THE INVENTION

Figure 1:
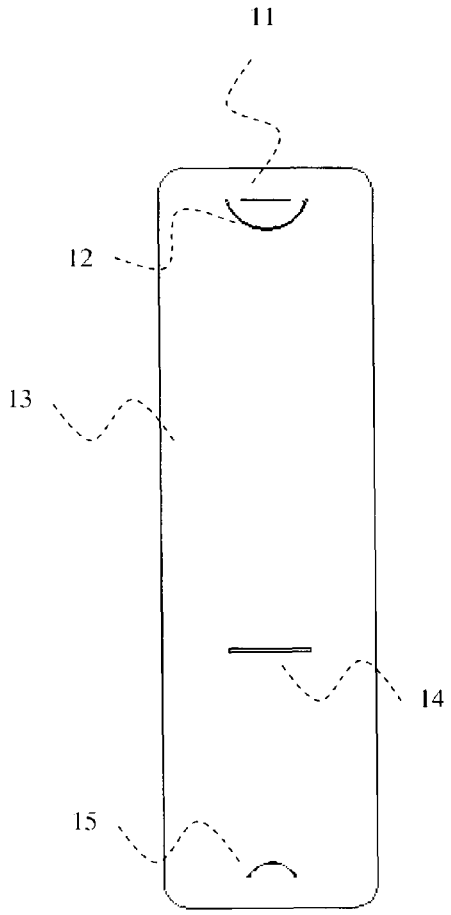
FIG. 1 is a top view of a foldable sheet used in a self-supporting toilet paper roll holder assembly that does not comprise a supporting sheet.

The present invention provides toilet paper roll holder assembly that is reversibly assembled and disassembled.

In one aspect of the present invention is provided a toilet paper roll holder assembly comprising:

a. at least one foldable sheet folded around itself;

b. first engagement means for engaging the foldable sheet to itself;

c. second engagement means for engaging the foldable sheet to another foldable sheet, or third engagement means for engaging the foldable sheet to supporting sheet, where the supporting sheet is not in folded form. The second engagement means is the first engagement means or different engagement means. The third engagement means is the first engagement means or different engagement means. The first, second and third engagement means are placed in proximity to the edges of the foldable sheet. The second engagement means of the first foldable sheet may engage with the other foldable sheet at a predetermined location at the lower part of the other foldable sheet. The foldable sheets in their folded form provide closed space for holding toilet paper roll. The engagement means enables reversible assembling and disassembling of the toilet paper roll holder, and the foldable sheets and the supporting sheet are made of synthetic material.

In another aspect of the present invention is provided a toilet paper roll holder assembly, where the first, second and third engagement means are selected from the group consisting of buttons, scotch strips, double-sided adhesive tapes, open-ended rings sliding through holes cut off in proximity to the edges of the foldable sheet, clips, and strip and slit couplings, where the strip is partially sliced off the foldable sheet in proximity to one edge of the foldable sheet, and the slit is cut off in proximity to the opposite edge of the foldable sheet or at a predetermined location at the lower part of another foldable sheet or of a supporting sheet. The strip is fit to slide through the slit thereby locking the edges of the foldable sheet one to the other or engaging one folded sheet to the other or to the supporting sheet.

In one aspect of the present invention various modes of strip-slit couplings are provided as engagement means for engaging one edge of the foldable sheet to the opposite edge, and one foldable sheet to another foldable sheet, where both sheets are in their folded form, or to a supporting sheet.

In one particular embodiment of the present invention, the first, second and third engagement means are strip-slit couplings, where the strip is partially sliced off the foldable sheet in proximity to one of the sheet edges and has extensions in the form of anchors at its margins, and the slit is cut off the foldable sheet at the edge opposite to the edge where the strip is located, or at a predetermined location at the lower part of another foldable sheet or at the supporting sheet, and has notches extending beneath it and is at a length smaller than the length of the base of the strip. Once the strip is slid through the slit, then the anchors of the strip fall inside the notches of the slit, thus securing the locking of the strip to the slit. It should be noted that such strip-slit coupling is employed for both engaging one edge of a foldable sheet to the opposite edge and one foldable sheet to another foldable sheet, where both sheets are in their folded form, or to a supporting sheet.

In still another embodiment of the present invention is provided a single strip partially sliced off in proximity to one edge of a foldable sheet and coupled to both the slit at the opposite edge of the foldable sheet and either to a slit located at a predetermined location at the lower part of another foldable sheet or to a slit at a supporting sheet. The strip is fit to slide through the slits thereby locking the edges of the foldable sheet one to the other and engaging either one folded sheet to the other or to the supporting sheet.

In one particular embodiment of the present invention, the single strip is partially sliced off the foldable sheet in proximity to one of the sheet edges and has extensions in the form of anchors at its margins, and the slits are cut off the foldable sheet at the edge opposite to the edge where the strip is located, or at a predetermined location at the lower part of another foldable sheet and at the supporting sheet, each slit having notches extending beneath it and is at a length smaller than the length of the base of the strip. Once the strip is slid through the slits, then the anchors of the strip fall inside the notches of the slits, thus securing the locking of the strip to the slits. It should be noted that such strip-slit coupling is employed for both engaging one edge of a foldable sheet to the opposite edge and one foldable sheet to another foldable sheet, where both sheets are in their folded form, or to a supporting sheet.

In another aspect of the present invention the foldable sheet and the supporting sheet are each independently made of synthetic material selected from the group consisting of vinyl polymers, in particularly, polypropylene and polyethylene, polyurethane, vinyl polymers, in particular polyvinylchloride (PVC), styrene polymers, in particular polystyrene, polyethyleneterphthalate, elastomer polymers, or any combination thereof.

In one embodiment of the present invention the foldable sheet and the supporting sheet are made of printable synthetic material.

In another embodiment of the present invention the combination of the printing on the foldable sheets of the toilet paper roll holder assembly or in combination with the supporting sheet form a graphic pattern, design, script, writing, colors or any combination thereof.

In still another aspect of the present invention the foldable sheet and the supporting sheet are washable in water and are detergent resistant.

In one embodiment of the present invention the foldable sheet is made of elastic synthetic material, where the elastic synthetic material enables the foldable sheet to expand and contract according to the dimensions of a paper roll placed in the closed space formed by the foldable sheet in its folded form.

In still another embodiment of the present invention the foldable elastic sheet is in a network shape.

In still another embodiment of the present invention the toilet paper roll holder assembly further comprises storage container, that is engaged to the lowest foldable sheet with the second engagement means or to the supporting sheet with the third engagement means, where the engagement means enable reversible engagement and disengagement of the storage container to and from the foldable sheet or to and from the supporting sheet.

In still another embodiment of the present invention the storage container is intended for holding accessories for toilet or personal hygienic use, preferably the accessories are female hygienic care accessories.

In one aspect of the present invention the foldable sheet may be separately disengaged from the assembly and replaced with another foldable sheet.

In still another aspect of the present invention the toilet paper roll holder assembly comprises any number of foldable sheets in their folded form, and the location of any folded sheets may be independently relocated in the assembly or replaced with a different folded sheet.

In one particular embodiment of the present invention is provided toilet paper roll holder assembly that comprises a multiple of polypropylene foldable sheets, where each sheet is folded around itself with its edges engaged with strip-slit coupling, where the strip is partially sliced off each sheet in proximity to one edge of the sheet, and the slit is cut off the sheet in proximity to the opposite edge of the sheet. The strip is fit to slide through the slit thereby locking the edges of each sheet one to the other. The folded sheet is engaged to another folded sheet above it with a second strip that is sliced off the other edge of the foldable sheet and beneath the slit that is cut off the sheet. The second strip is slid through a slit located at the lower part of the other folded sheet, and each sheet in its folded form provides closed space for holding toilet paper roll, where the strip-slit couplings enable a reversible assembling and disassembling of the toilet paper roll holder.

In still another particular embodiment of the present invention is provided a toilet paper roll holder assembly comprising a multiple of polypropylene foldable sheets, where each sheet is folded around itself with its edges engaged with strip-slit coupling, where the strip is partially sliced off each sheet in proximity to one edge of the sheet, and the slit is cut off the sheet in proximity to the opposite edge of the sheet. The strip is fit to slide through the slit, thereby locking the edges of each sheet one to the other, and each folded sheet is engaged to a supporting sheet with a second strip that is partially sliced off the other edge of the sheet, and that is slid through a slit cut through the supporting sheet. Each sheet in its folded form provides closed space for holding toilet paper roll, where the strip-slit couplings enable a reversible assembling and disassembling of the toilet paper roll holder.

In still another embodiment of the present invention is provided a toilet paper roll holder assembly, where the surface of each sheet comprises a printed form, preferably the combination of the printing on the folded sheets forms a graphic pattern or design. Preferably the graphic pattern or design is annual or monthly calendar, commercial advertising or trademark, a script or any combination thereof.

In still another aspect of the present invention is provided a method for preparing toilet paper roll holder assembly comprising the steps:

a. obtaining at least one foldable sheet;

b. obtaining first engagement means for engaging the foldable sheet to itself; and c. obtaining second engagement means for engaging the foldable sheet to another foldable sheet, or supporting sheet and third engagement means for engaging the foldable sheet to supporting sheet, the supporting sheet is not in folded form;

d. folding one foldable sheet around itself along the length of the foldable sheet and engaging one edge to the opposite edge of the foldable sheet with the first engagement means, optionally engaging said foldable sheet in folded form with said supporting sheet by employing said third engagement means; optionally e. engaging the folded sheet with another folded sheet by employing second engagement means for engaging one folded sheet to another; and f. reiterating steps a-e for obtaining toilet paper roll holder assembly that comprises multiple folded sheets.

In still another aspect of the present invention is provided a method for assembling toilet paper roll holder where the first and another foldable sheets in their folded form provide closed space for holding toilet paper roll, and the engagement means enable reversible assembling and disassembling of the toilet paper roll holder.

In still another aspect of the present invention is provided a method for assembling toilet paper roll holder where the foldable sheets and the supporting sheet are made of synthetic material.

In one embodiment of the present invention, the method for assembling a toilet paper roll holder assembly where the second engagement means is the first engagement means or different engagement means, the third engagement means is the first engagement means or different engagement means, and where the first, second and third engagement means are placed in proximity to opposite edges of the foldable sheet. The second engagement means of the first foldable sheet may engage with the other foldable sheet at a predetermined location at the lower part of the other foldable sheet, and the third engagement means may engage the first foldable sheet with a supporting sheet.

In still another embodiment of the present invention the first, second and third engagement means employed in the method as described above are selected from the group consisting of buttons, scotch strips, double-sided adhesive tapes, open-ended rings sliding through holes cut off in proximity to the edges of the foldable sheet, clips, and strip and slit couplings, where the strip is partially sliced off the foldable sheet in proximity to one edge of the foldable sheet, and the slit is cut off in proximity to the opposite edge of the foldable sheet or at a predetermined location at the lower part of another foldable sheet or a supporting sheet. The strip is fit to slide through the slit thereby locking the edges of the foldable sheet one to the other or engaging the foldable sheet to another foldable sheet, where the sheet are in their folded form, or to the supporting sheet.

In still another embodiment of the present invention the first, second and third engagement means employed in the method for assembling toilet paper roll holder as described above are provided in various modes of locking of strip-slit couplings.

In one particular embodiment of the present invention the method as described above employs strip-slit couplings for assembling toilet paper roll holder, where the strip is partially sliced off the foldable sheet in proximity to one of the sheet edges and has extensions in the form of anchors at its margins, and the slit has notches extending beneath it and is in a length smaller than the length of the base of the strip, and is cut off the sheet in proximity to the edge opposite to the edge where the strip is located or at a predetermined location at the lower part of another foldable sheet or a supporting sheet. Once the strip is slid through the slit, then the anchors of the strip fall inside the notches of the slit, thus securing the locking of the strip to the slit. The strip-slit coupling is employed for both engaging one edge of a foldable sheet to the opposite edge and one foldable sheet to another foldable sheet, where both sheets are in their folded form, or to a supporting sheet.

In still another embodiment of the present invention the method as described above employs a single strip partially sliced off in proximity to one edge of a foldable sheet and coupled to both the slit at the opposite edge of the foldable sheet and either to a slit located al a predetermined location at the lower part of another foldable sheet or to a slit at a supporting sheet. The strip is fit to slide through the slits thereby locking the edges of the foldable sheet one to the other and engaging either one folded sheet to the other or to the supporting sheet.

In one particular embodiment of the present invention, the method as described above employs a single strip partially sliced off the foldable sheet in proximity to one of the sheet edges and has extensions in the form of anchors at its margins, and the slits are cut off the foldable sheet at the edge opposite to the edge where the strip is located, and at a predetermined location at the lower part of another foldable sheet or at the supporting sheet, each slit having notches extending beneath it and is at a length smaller than the length of the base of the strip. Once the strip is slid through the slits, then the anchors of the strip fall inside the notches of the slits, thus securing the locking of the strip to the slits. It should be noted that such strip-slit coupling is employed for both engaging one edge of a foldable sheet to the opposite edge and one foldable sheet to another foldable sheet, where both sheets are in their folded form, or to a supporting sheet.

In still another aspect the present invention provides a kit for assembling toilet paper roll holder assembly comprising:

a. at least one foldable sheet;

b. first engagement means for engaging said foldable sheet to itself;

c. second engagement means for engaging the foldable sheet to another foldable sheet, or supporting sheet and third engagement means for engaging the foldable sheet to supporting sheet, where the supporting sheet is not in folded form.

The second engagement means is the first engagement means or different engagement means, and the third engagement means is the first engagement means or different engagement means. The first, second and third engagement means are placed in proximity to the edges of the foldable sheet or upon assembling the toilet paper roll holder. The second engagement means of the first foldable sheet may engage with the other foldable sheet at a predetermined location at the lower part of the other foldable sheet. The first and another foldable sheets in their folded form provide closed space for holding toilet paper roll. The engagement means enable reversible assembling and disassembling of the toilet paper roll holder; and the foldable sheets and supporting sheet are made of synthetic material.

In one embodiment of the present invention is provided a kit where the first, second and third engagement means are selected from the group consisting of buttons, scotch strips, double-sided adhesive tapes, open-ended rings sliding through holes cut off in proximity to the edges of the foldable sheet, clips, and strip and slit couplings, where the strip is partially sliced off said foldable sheet in proximity to one edge of the foldable sheet, and the slit is cut off in proximity to the opposite edge of the foldable sheet or at a predetermined location at the lower part of another foldable sheet or a supporting sheet. The strip is fit to slide through the slit thereby locking the edges of the foldable sheet one to the other or engaging the foldable sheet to another foldable sheet, where the sheets are in folded form, or to a supporting sheet.

In still another embodiment of the present invention is provided a kit where the first, second and third engagement means are provided in various modes of locking of strip-slit couplings.

In one particular embodiment of the present invention is provided a kit where the strip is partially sliced off the foldable sheet in proximity to one of the sheet edges and has extensions in the form of anchors at its margins, and the slit has notches extending beneath it and is in a length smaller than the length of the base of the strip, the strip being located at the edge of the foldable sheet opposite to the edge of the strip, or at a predetermined location at the lower part of another foldable sheet or a supporting sheet, wherein once the strip is slid through the slit, then the anchors of the strip fall inside the notches of the slit, thus securing the locking of the strip to the slit, the strip-slit coupling is employed for both engaging one edge of a foldable sheet to the opposite edge and one foldable sheet to another foldable sheet, where both sheets are in their folded form, or to a supporting sheet.

In still another embodiment of the present invention the kit as described above provides a single strip partially sliced off in proximity to one edge of a foldable sheet and coupled to both the slit at the opposite edge of the foldable sheet and either to a slit located at a predetermined location at the lower part of another foldable sheet or to a slit at a supporting sheet. The strip is fit to slide through the slits thereby locking the edges of the foldable sheet one to the other and engaging either one folded sheet to the other or to the supporting sheet.

In one particular embodiment of the present invention, the kit as described above provides a single strip that is partially sliced off the foldable sheet in proximity to one of the sheet edges and has extensions in the form of anchors at its margins, and the slits are cut off the foldable sheet at the edge opposite to the edge where the strip is located, or at a predetermined location at the lower part of another foldable sheet or at the supporting sheet, each slit having notches extending beneath it and is at a length smaller than the length of the base of the strip. Once the strip is slid through the slits, then the anchors of the strip fall inside the notches of the slits, thus securing the locking of the strip to the slits. It should be noted that such strip-slit coupling is employed for both engaging one edge of a foldable sheet to the opposite edge and one foldable sheet to another foldable sheet, where both sheets are in their folded form, or to a supporting sheet.

DETAILED DESCRIPTION OF THE DRAWINGS

FIG. 1 is a particular embodiment of the present invention, illustrating a foldable sheet that is used in a self-supporting toilet paper roll holder assembly. The sheet (13) is in a shape of a strip having defined length and width and characterized in that the engagement means are a semi-circle strip (15) that is only partially sliced off the surface of the sheet (13) in proximity to its lower edge. A suitable slit (11) is cut close to the upper edge of the foldable sheet, and is in such length and width that enable sliding the strip (15) through it. Once the sheet is folded around itself, then such strip-slit coupling allows locking the folded configuration of the sheet, thereby forming a closed space in a shape of a cylinder in which a paper roll may be comfortably introduced. The slit (14) appearing at the lower part of the sheet is used to engage one folded sheet to the next by simply sliding through it the strip (12) and locking. This way a continuous chain of folded sheets that is essentially self-supporting may be built according to the user desire and needs. Such chain may be easily assembled and disassembled. Furthermore, in case the sheets are provided with printed patterns, colors or script for example, then their assembly may be carried out at a variety of combinations, and adapted according to the taste and style of the end-user or a particular desired combination.

Figure 2:
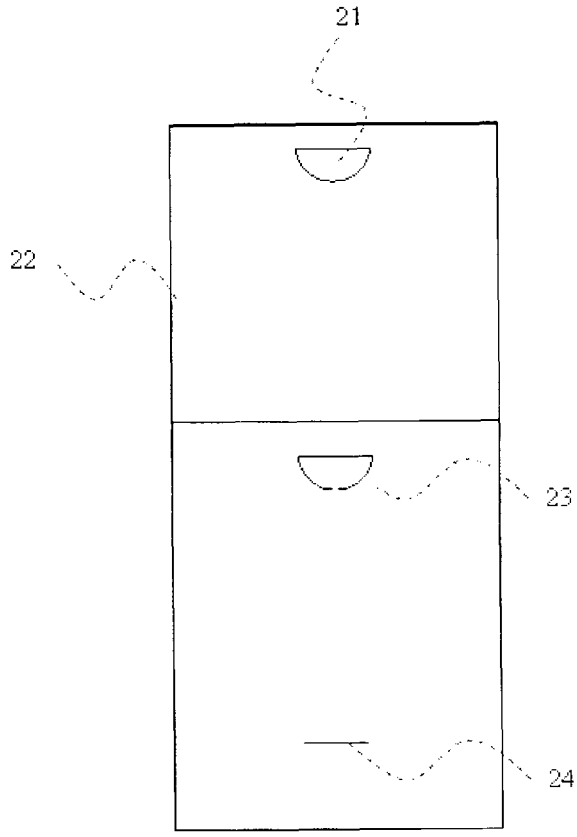
FIG. 2 is a projection of the front of a self-supporting toilet paper roll holder assembly.

In FIG. 2 a projection of the rear of a toilet paper roll holder assembly is shown. The semi-circle strip (21) is slid through the slit of the upper folded sheet (22) and locking it. Element (23) in FIG. 2 represents both the strip-slit coupling of the lower foldable sheet in its folded form and the engagement of the lower sheet to the upper sheet with strip-slit coupling using a second strip as appearing in FIG. 1 (12) that is slid through a slit as appearing in FIG. 1 (14). Element (24) is the slit located at lower part of the lower foldable sheet and can be used to engage another folded sheet using strip-slit coupling.

Figure 3:
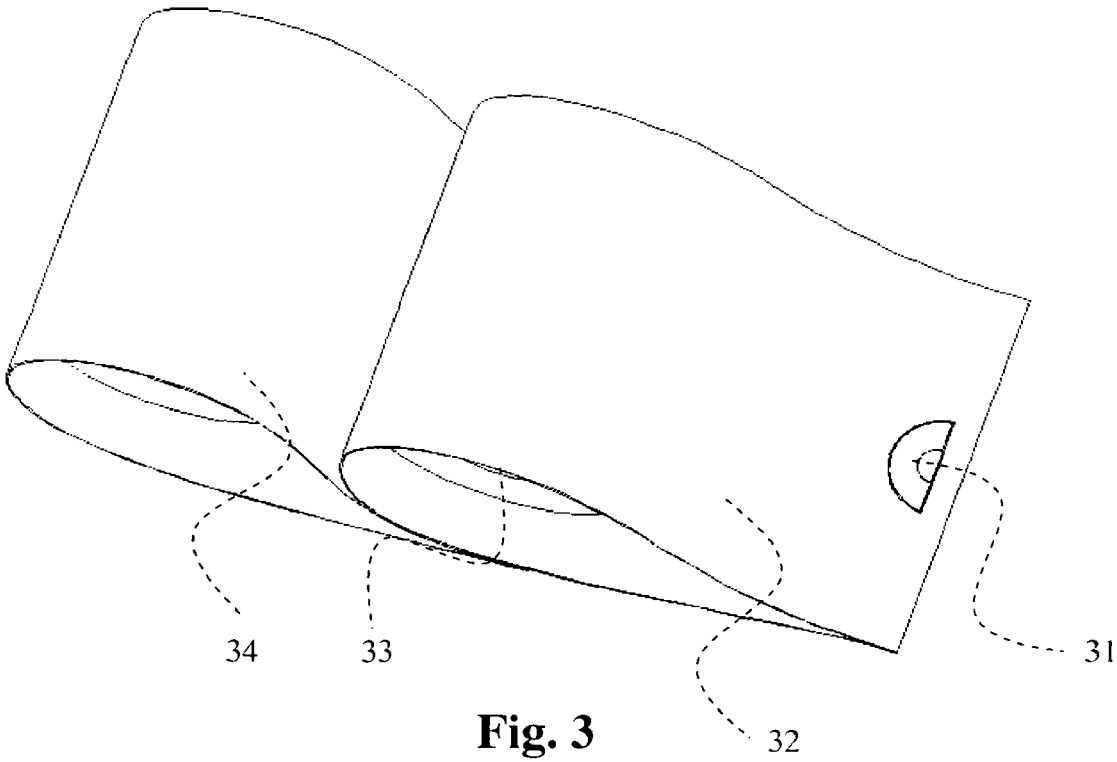
FIG. 3 is a perspective view of a self-supporting toilet paper roll holder assembly.
Figure 4:
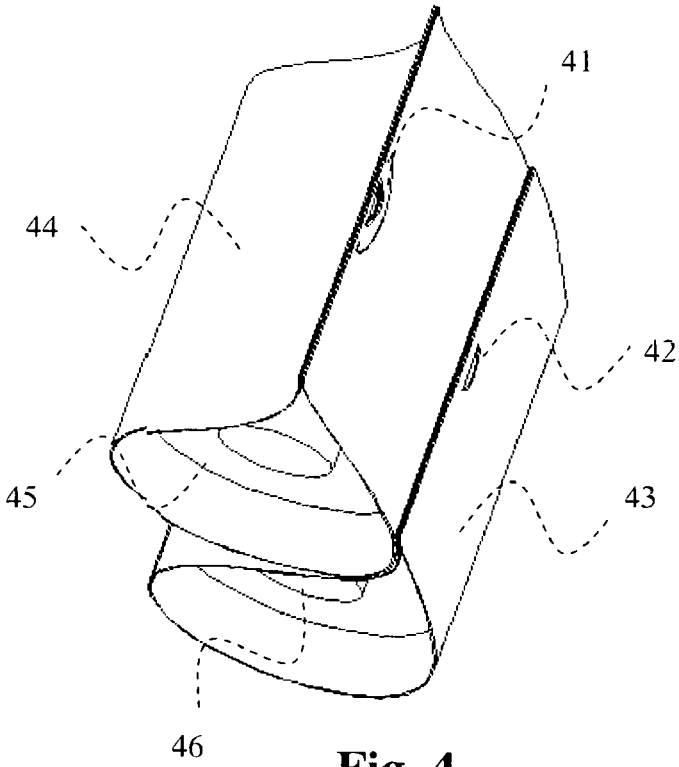
FIG. 4 is a top view of a self-supporting toilet paper roll holder assembly.

FIGS. 3 and 4 are, respectively, an illustration of top and side perspective views of two cylinders self-supporting toilet paper roll holder. Both FIGS. 3 and 4 shows the engaging semi-circle strips (31), (41) and (42) that are used to lock the sheets in folded form and engage one folded sheet to the next, namely (32) to (34), and (43) to (44). Element (42) also represents the engagement of lower folded sheet (43) to upper folded sheet (44). The folded sheets form each a closed cylindrical space (33), (45) and (46) that allows comfortable storage of paper roll.

Figure 5:
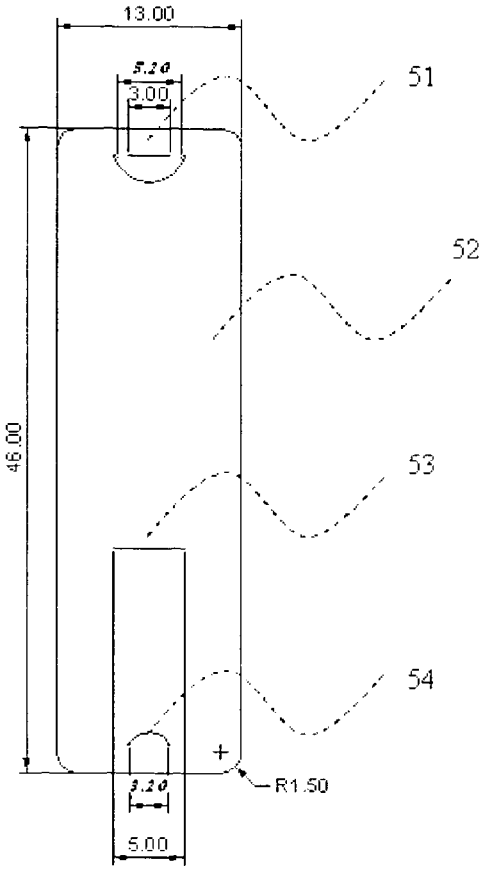
FIG. 5 is a top view of a foldable sheet with exact dimensions used in a self-supporting toilet paper roll holder.

In FIG. 5 particular dimensions and measures of a foldable sheet (52) and its features are shown, namely the length and width of the sheet, the length of the semi-circle strip (54) and the slit (51) that are coupled together in order to lock the sheet in a folded form, and the slit (53) appearing at the lower part of the sheet and that is used to engage one folded sheet to the next one.

Figure 6:
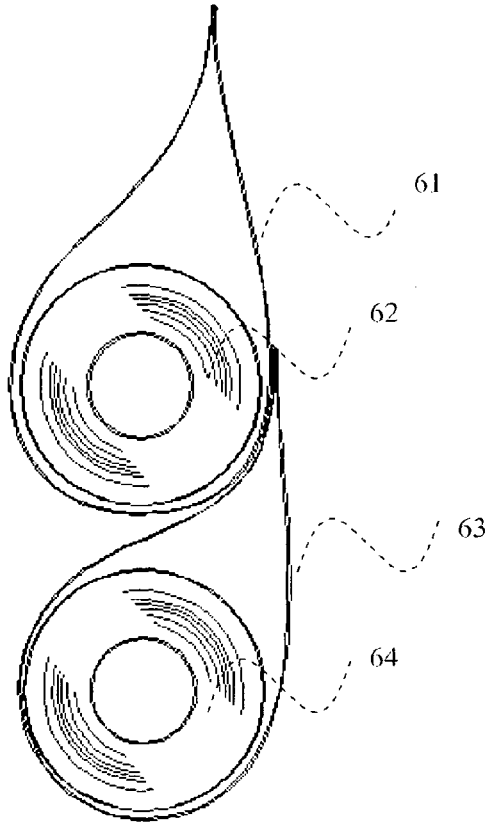
FIG. 6 is side view of a self-supporting toilet paper roll holder assembly demonstrating its use with paper rolls held in it.

FIG. 6 is a demonstration of the use of the assembly, showing it in a side view with paper rolls (62) and (64) stored in the closed spaces formed by the folded sheets (61) and (64).

Figure 7:
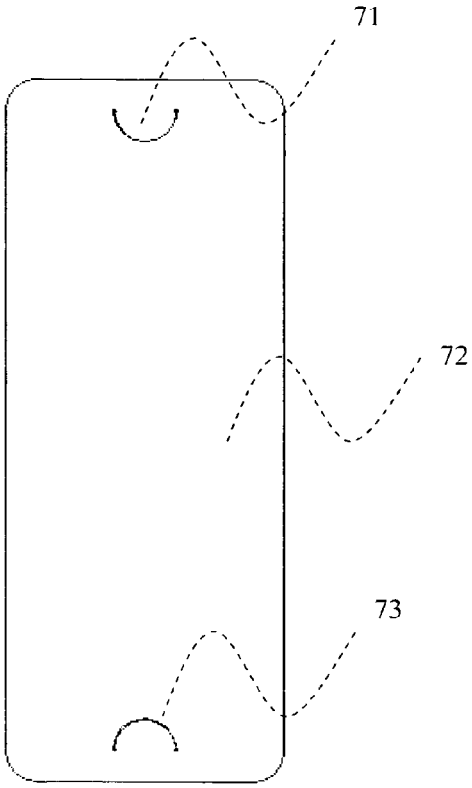
FIG. 7 is a top view of a supported foldable sheet used in a toilet paper roll holder assembly that comprises a supporting sheet.
Figure 8:
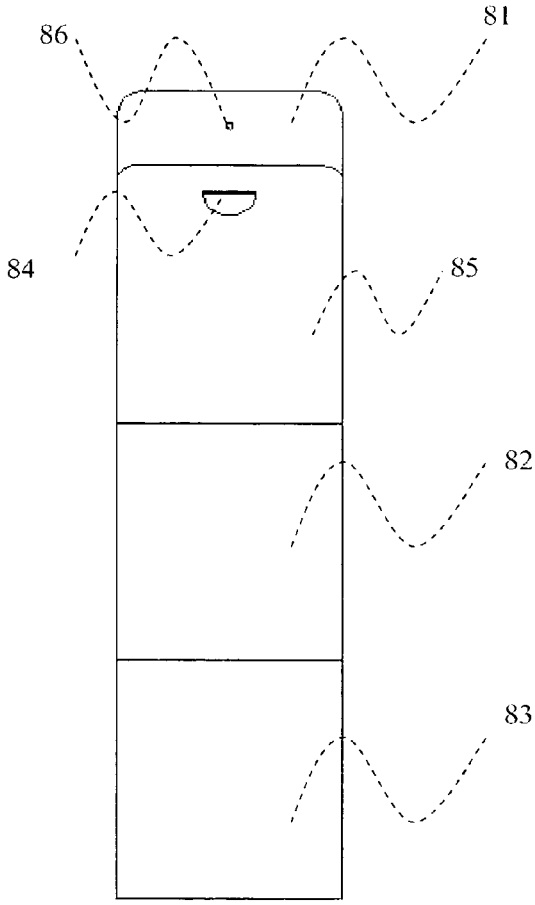
FIG. 8 is a projection of the front of a supported toilet paper roll holder assembly that comprises a supporting sheet.

FIG. 7 is another particular embodiment of the present invention, illustrating a foldable sheet (72) in unfolded form having semi-circle strips (73) and (71) that are coupled, respectively with a slit located at the other edge of the sheet and a slit located at the supporting sheet, in order to lock the folded form of the sheet (72) and the sheet in its folded form (72) to the supporting sheet. In FIG. 8 is illustrated a front view projection of a supported paper roll holder assembly that comprises a supporting sheet (81) to which all folded sheets (82), (83) and (85) are engaged. The locking strip-slit coupling (84) is illustrated at the upper folded sheet (85). The circle hole (86) is used to hang the toilet paper roll holder to any suitable rack, anchor or hook.

Figure 9:
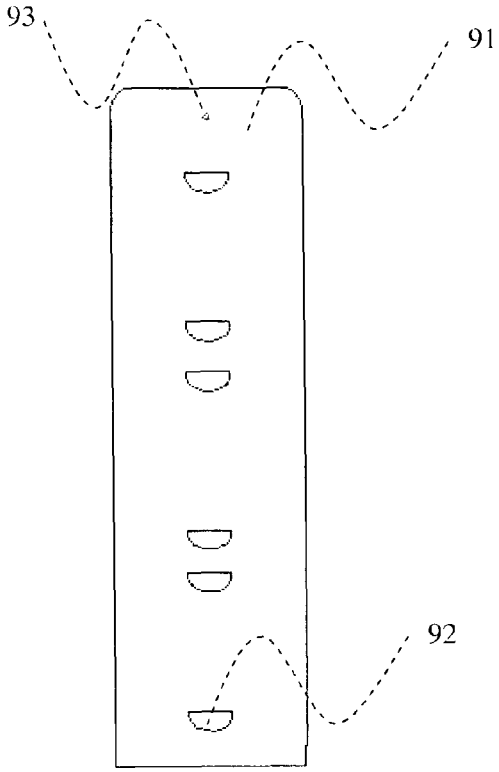
FIG. 9 is a projection of the rear of a supported toilet paper roll holder assembly that comprises a supporting sheet.
Figure 10:
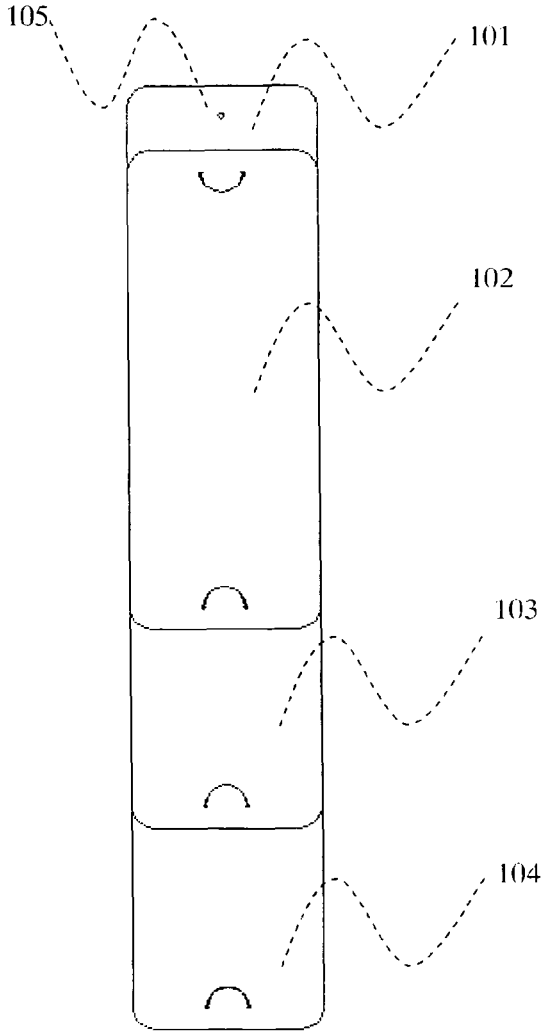
FIG. 10 is a projection of the top of a supported toilet paper roll holder assembly that comprises a supporting sheet where all sheets are in unfolded form.

A top projection illustration of the rear side of a supported toilet paper roll holder assembly is shown in FIG. 9. The strip-slit couplings (92) protrude outside the rear side of the supporting sheet (91), either locking the folded form of the sheets or engaging each to the supporting sheet (91). The circle hole (93) is used to hang the toilet paper roll holder to any suitable rack, anchor or hook. FIG. 10 is a top view of the assembly illustrated in FIG. 9 in its pre-folded configuration, where all foldable sheets (102), (103) and (104) appear in unfolded form on top of the supporting sheet (101). The circle hole (105) is used to hang the toilet paper roll holder to any suitable rack, anchor or hook.

Figure 11:
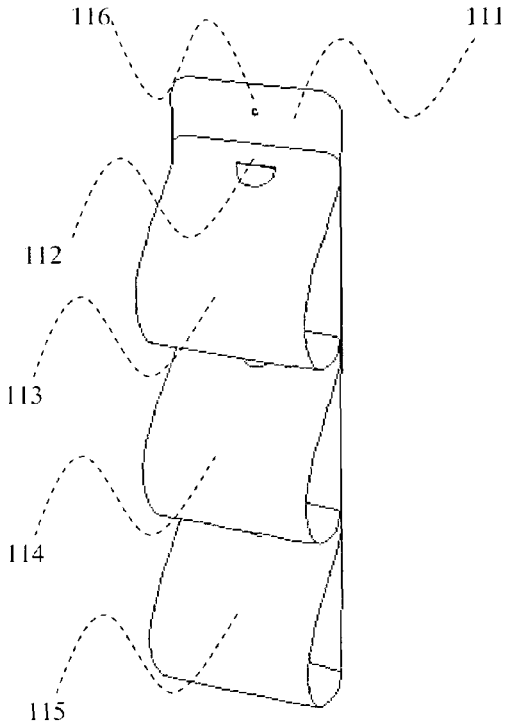
FIG. 11 is a perspective view of a supported toilet paper roll holder assembly that comprises a supporting sheet.
Figure 12:
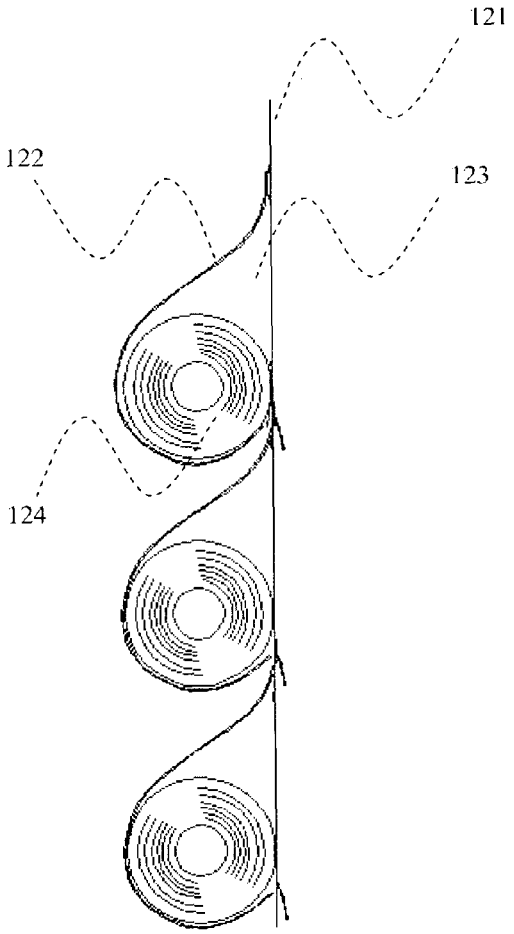
FIG. 12 is a side view of a supported toilet paper roll holder assembly that comprises a supporting back and holding toilet paper rolls.

Finally, FIGS. 11 and 12 are, respectively, perspective and side views of a supported toilet paper holder assembly, illustrating the supported sheet (111), (121), to which the folded sheets, for example (113), (114) and (115) in FIG. 11, and (122) in FIG. 12, are encased. The closed configuration of such folded sheets forms a closed cylindrical space, for example (123) in FIG. 12, to which a toilet paper roll (124) is comfortably introduced and stored. The circle hole (116) is used to hang the toilet paper roll holder to any suitable rack, anchor or hook.

Figure 13:
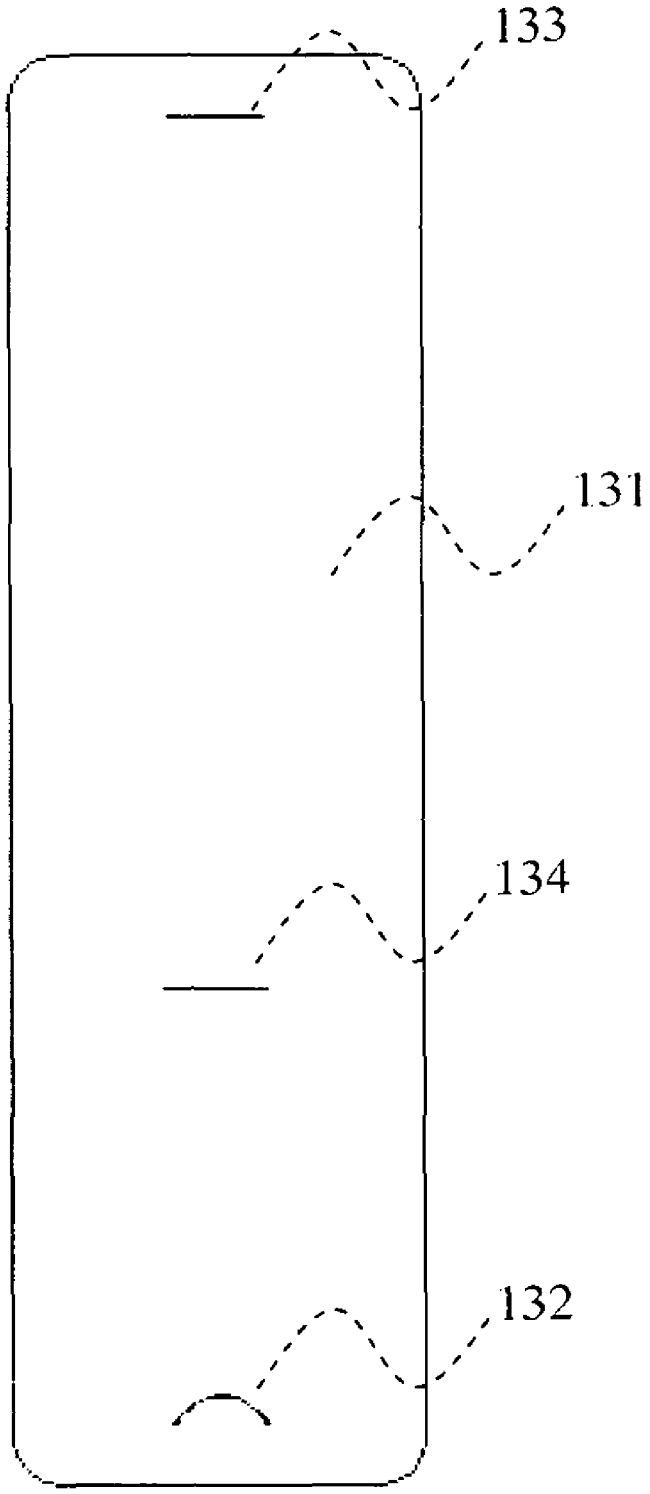
FIG. 13 is a top view of a foldable sheet with a single strip and two slits.

FIG. 13 schematically describes a foldable sheet (131) having engagement means in the form of a single strip (132) located in proximity to one of its edges, a slit (133) located in proximity to the edge opposite the edge of the strip (132) and a slit (134) located at the lower part of the sheet. When assembling a self-supporting toilet paper roll holder, then once the sheet (131) is folded around itself, then the strip (132) is coupled to the slit (133) at the opposite edge by sliding through the slit (133), and upon engaging the sheet (131) in its folded form with another folded sheet then the same strip (132) couples to the slit (134) located at the lower part of the other folded sheet. Alternatively, when the assembly is a supported one, then the strip (132) is coupled with a slit at the supporting sheet by sliding the strip (132) through that slit, thus, engaging the folded sheet (131) to the supporting sheet.

Although the present invention has been described with reference to preferred embodiments, workers skilled in the art will recognize that changes may be made in form and detail without departing from the spirit and scope of the invention.

The invention claimed is:

1. Toilet paper roll holder assembly comprising: a. at least one foldable sheet folded around itself; b. first engagement means for engaging said foldable sheet to itself; c. second engagement means for engaging said foldable sheet to another foldable sheet, or third engagement means for engaging said foldable sheet to supporting sheet, said supporting sheet is not in folded form; said second engagement means and said first engagement means are the same or different engagement means; said third engagement means and said first engagement means are the same or different engagement means; said first, second and third engagement means are placed in proximity to the edges of said foldable sheet; said first engagement means of said first foldable sheet engages with second engagement means of said another foldable sheet at a predetermined location in proximity to first engagement means of said another foldable sheet; said first, second and third engagement means are strip and slit couplings, said strip is partially sliced off said foldable sheet in proximity to one edge of said foldable sheet, and said slit is cut off in proximity to the opposite edge of said foldable sheet or at a predetermined location at the lower part of another foldable sheet or a supporting sheet, said strip is fit to slide through said slit thereby locking the edges of said foldable sheet one to the other or, engaging said foldable sheet to another foldable sheet, said sheets are in folded form, or to the supporting sheet; said first and another foldable sheets in their folded form providing closed space for holding toilet paper roll; said engagement means enabling reversible assembling and disassembling of said toilet paper roll holder; said foldable sheets and said supporting sheet are made of synthetic material and wherein said first, second, and third engagement means are provided in various modes of locking of strip-slit couplings.

2. Toilet paper roll holder assembly according to claim 1, wherein the strip is partially sliced off the foldable sheet in proximity to one of the sheet edges and has extensions in the form of anchors at its margins, and the slit has notches extending beneath it and is at a length smaller than the length of the base of the strip and is located at said foldable sheet in proximity to the edge opposite the edge of said strip or at a predetermined location at the lower part of another foldable sheet or a supporting sheet, wherein once said strip is slid through said slit, then said anchors of said strip fall inside said notches of said slit, thus securing the locking of said strip to said slit; the strip-slit coupling is employed for both engaging one edge of a foldable sheet to the opposite edge or one foldable sheet to another foldable sheet, where both sheets are in their folded form, or to the supporting sheet.

3. Toilet paper roll holder assembly according to claim 1, wherein a single strip is partially sliced off in proximity to one edge of said foldable sheet and coupled to both a slit at the opposite edge of the foldable sheet and either to a slit located at a predetermined location at the lower part of another foldable sheet or to a slit at a supporting sheet, the strip being fit to slide through the slits thereby locking the edges of said foldable sheet one to the other and engaging either one folded sheet to the other or to the supporting sheet.

4. Toilet paper roll holder assembly according to claim 3, wherein said single strip is partially sliced off the foldable sheet in proximity to one of the sheet edges and has extensions in the form of anchors at its margins, and the slits are cut off the foldable sheet at the edge opposite to the edge where the strip is located, and at a predetermined location at the lower part of another foldable sheet or at the supporting sheet, each slit having notches extending beneath it and is at a length smaller than the length of the base of the strip; once said strip is slid through the slits, then the anchors of said strip fall inside the notches of said slits, thus securing the locking of said strip to the slits; the strip-slit coupling is employed for both engaging one edge of a foldable sheet to the opposite edge and one foldable sheet to another foldable sheet, where both sheets are in their folded form, or to the supporting sheet.

5. Toilet paper roll holder assembly according to claim 1, wherein said foldable sheet and said supporting sheet are each independently made of synthetic material selected from the group consisting of polypropylene, polyethylene, polyurethane, styrene polymers, vinyl polymers, preferably polyvinylchloride, elastomer polymers, or any combination thereof.

6. Toilet paper roll holder assembly according to claim 1, wherein said foldable sheet and said supporting sheet are made of printable synthetic material.

7. Toilet paper roll holder assembly according to claim 6, wherein the combination of the printing on the foldable sheets or in combination with the supporting sheet form a graphic pattern, design, script, writing, colors or any combination thereof.

8. Toilet paper roll holder assembly according to claim 1, wherein said foldable sheet and said supporting sheet are washable in water and are detergent resistant.

9. Toilet paper roll holder assembly according to claim 1, wherein said foldable sheet comprises elastic synthetic material, said elastic synthetic material enables said foldable sheet to expand and contract according to the dimensions of paper roll placed in the closed space formed by said foldable sheet in its folded form.

10. Toilet paper rolls holder assembly according to claim 9, wherein said foldable sheet is in a network shape.

11. Toilet paper roll holder assembly according to claim 1, further comprising storage container, said storage container being engaged to the lowest foldable sheet with the second engagement means or to the supporting sheet with the third engagement means, said engagement means enabling reversible engagement and disengagement of said storage container to and from said foldable sheet or said supporting sheet.

12. Toilet paper roll holder assembly according to claim 11, wherein said storage container is intended for holding accessories for toilet or personal hygienic use, preferably said accessories are female hygienic care accessories.

13. Toilet paper roll holder assembly according to claim 1, wherein each foldable sheet may be separately disengaged from said assembly and replaced with another foldable sheet.

14. Toilet paper roll holder assembly according to claim 1, wherein said assembly comprises any number of foldable sheets in their folded form, and the location of any folded sheets may.be independently relocated in the assembly or replaced with a different folded sheet.

15. Toilet paper roll holder assembly comprising a multiple of polypropylene foldable sheets, each sheet is folded around itself with its edges engaged one to the other with strip-slit coupling, where the strip is partially sliced off the surface of each sheet in proximity to one edge of the sheet, and the slit is cut off the sheet in proximity to the other edge of the sheet, the strip is fit to slide through the slit thereby locking the edges of each sheet one to the other, and the folded sheet is engaged to another folded sheet above it with said strip that is slid to a second slit located in proximity to the strip of the other folded sheet each sheet in its folded form providing closed space for holding toilet paper roll, where the strip-slit couplings enable reversible assembling and disassembling of the toilet paper roll holder.

16. Toilet paper roll holder assembly comprising a multiple of polypropylene foldable sheets, each sheet is folded around itself with its edges engaged one to the other with strip-slit coupling, where the strip is partially sliced off the surface of each sheet in proximity to one edge of the sheet, and the slit is cut off the sheet in proximity to the opposite edge of the sheet, the strip is fit to slide through the slit thereby locking the edges of each sheet one to the other, each folded sheet is engaged to a supporting sheet by sliding said strip through a second slit cut through the supporting sheet, each sheet in its folded form providing closed space for holding toilet paper roll, where the strip-slit couplings enable a reversible assembling and disassembling of the toilet paper roll holder.

17. Toilet paper roll holder assembly according to claim 15, wherein the surface of each sheet comprises a printed form, preferably the combination of the printing on the folded sheets forms a graphic pattern or design, preferably said graphic pattern or design is annual or monthly calendar, commercial advertising or trademark, a script or any combination thereof, wherein said foldable sheet and said supporting sheet are washable in water and are detergent resistant 18. Toilet paper roll holder assembly according to claim 16, wherein the surface of each sheet comprises a printed form, preferably the combination of the printing on the folded sheets forms a graphic pattern or design, preferably said graphic pattern or design is annual or monthly calendar, commercial advertising or trademark, a script or any combination thereof, wherein said foldable sheet and said supporting sheet are washable in water and are detergent resistant.

19. A method for preparing toilet paper roll holder assembly comprising the following steps: a. obtaining at least one foldable sheet; b. obtaining first engagement means for engaging said foldable sheet to itself; and c. obtaining second engagement means for engaging said foldable sheet to another foldable sheet, or supporting sheet and third engagement means for engaging said foldable sheet to supporting sheet, said supporting sheet is not in folded form; d. folding one foldable sheet around itself along the length of the foldable sheet and engaging one edge to the opposite edge of the foldable sheet with the first engagement means; e. engaging said foldable sheet in folded form with said supporting sheet by employing said third engagement means; or engaging the folded sheet with another folded sheet by employing second engagement means of said another foldable sheet for engaging with said first engagement means of said first folded sheet, said second engagement means are located at a predetermined location in proximity to said first engagement means of said another foldable sheet; and f. reiterating steps a-e for obtaining toilet paper roll holder assembly that comprises multiple folded sheets; said first and another foldable sheets in their folded form providing closed space for holding toilet paper roll; said engagement means enabling reversible assembling and disassembling of said toilet paper roll holder; said foldable sheets and said supporting sheet are made of synthetic material.

20. A method according to claim 19, wherein said second and first engagement means are the same or different engagement means; said third engagement means is said first engagement means or different engagement means; said first, second and third engagement means are placed in proximity to the edges of said foldable sheet; said second engagement means of said first foldable sheet may engage with said another foldable sheet at a predetermined location at the lower part of said another foldable sheet: said third engagement means may engage said first foldable sheet with said supporting sheet.

21. A method according to claim 19, wherein said first, second and third engagement means are selected from the group consisting of buttons, scotch strips, double-sided adhesive tapes, open-ended rings sliding through holes cut off in proximity to the edges of the foldable sheet, clips, and strip and slit couplings, said strip is partially sliced off said foldable sheet in proximity to one edge of said foldable sheet, and said slit is cut off in proximity to the opposite edge of said foldable sheet or at a predetermined location at the lower part of another foldable sheet or supporting sheet, said strip is fit to slide through said slit thereby locking the edges of said foldable sheet one to the other or engaging said foldable sheet to another foldable sheet, said sheets are in folded form, or to the supporting sheet.

22. A method according to claim 21, wherein said first, second and third engagement means are provided in various modes of locking of strip-slit couplings.

23. A method according to claim 22, wherein the strip is partially sliced off the foldable sheet in proximity to one of the sheet edges and has extensions in the form of anchors at its margins, and the slit is cut off the foldable sheet at the opposite edge of the strip or at a predetermined location at the lower part of another foldable sheet or a supporting sheet, said slit has notches extending beneath it and is at a length smaller than the length of the base of the strip, once said strip is slid through said slit, then said anchors of said strip fall inside said notches of said slit, thus securing the locking of said strip to said slit, the strip-slit coupling is employed for both engaging one edge of a foldable sheet to the other edge and one foldable sheet to another foldable sheet, where both sheets are in their folded form, or to the supporting sheet.

24. A method according to claim 21, wherein a single strip partially sliced off in proximity to one edge of a foldable sheet and coupled to both the slit at the opposite edge of the foldable sheet and either to a slit located at a predetermined location at the lower part of another foldable sheet or to a slit at a supporting sheet, said strip is fit to slide through the slits thereby locking the edges of the foldable sheet one to the other and engaging either one folded sheet to the other or to the supporting sheet.

25. A method according to claim 24, wherein said single strip is partially sliced off the foldable sheet in proximity to one of the sheet edges and has extensions in the form of anchors at its margins, and the slits are cut off the foldable sheet at the edge opposite to the edge where the strip is located, and at a predetermined location at the lower part of another foldable sheet or at the supporting sheet, each slit having notches extending beneath it and is at a length smaller than the length of the base of the strip; once said strip is slid through the slits, then the anchors of the strip fall inside the notches of the slits, thus securing the locking of the strip to the slits; the strip-slit coupling is employed for both engaging one edge of a foldable sheet to the opposite edge and one foldable sheet to another foldable sheet, where both sheets are in their folded form, or to the supporting sheet.

26. A kit for assembling toilet paper roll holder assembly comprising: a. at least one foldable sheet; b. first engagement means for engaging said foldable sheet to itself; c. second engagement means for engaging said foldable sheet to another foldable sheet, or supporting sheet and third engagement means for engaging said foldable sheet to supporting sheet, said supporting sheet is not in folded form; said second engagement means and said first engagement means are the same or different engagement means; said first, second and third engagement means are strip and slit couplings, said strip is partially sliced off said foldable sheet in proximity to one edge of said foldable sheet, and said slit is cut off in proximity to the opposite edge of said foldable sheet or at a predetermined location at the lower part of another foldable sheet or a supporting sheet, said strip is fit to slide through said slit thereby locking the edges of said foldable sheet one to the other or engaging said foldable sheet to another foldable sheet, said sheets are in folded form, or to the supporting sheet; said first and another foldable sheets in their folded form providing closed space for holding toilet paper roll; said engagement means enabling reversible assembling and disassembling of said toilet paper roll holder: said foldable sheets and said supporting sheet are made of synthetic material and wherein said first, second, and thirdengagement means are provided in various modes of locking of strip-slit couplings.

27. A kit according to claim 26, wherein said first, second and third engagement means are provided in various modes of locking of strip-slit couplings.

28. A kit according to claim 27, wherein the strip is partially sliced off the foldable sheet in proximity to one of the sheet edges and has extensions in the form of anchors at its margins, and the slit is cut off the foldable sheet in proximity to the edge opposite to the edge of the strip, or at a predetermined location at the lower part of another foldable sheet or supporting sheet and has notches extending beneath it and is at a length smaller than the length of the base of the strip, wherein once said strip is slid through said slit, then said anchors of said strip fall inside said notches of said slit, thus securing the locking of said strip to said slit, the strip-slit coupling is employed for both engaging one edge of a foldable sheet to the opposite edge and one foldable sheet to another foldable sheet, where both sheets are in their folded form, or to the supporting sheet.

* * * * *